US012398726B2

(12) United States Patent
Sander et al.

(10) Patent No.: US 12,398,726 B2
(45) Date of Patent: Aug. 26, 2025

(54) FAN CASING WITH DEFINED BELT POCKET

(71) Applicant: The GSI Group, LLC, Assumption, IL (US)

(72) Inventors: Joshua Sander, Assumption, IL (US); Laszlo Talaber, Budapest (HU); Brian Daniel Duke, Shellbyville, IL (US)

(73) Assignee: The GSI Group, LLC, Assumption, IL (US)

( * ) Notice: Subject to any disclaimer, the term of this patent is extended or adjusted under 35 U.S.C. 154(b) by 0 days.

(21) Appl. No.: 18/892,901

(22) Filed: Sep. 23, 2024

(65) Prior Publication Data

US 2025/0101992 A1 Mar. 27, 2025

Related U.S. Application Data

(60) Provisional application No. 63/585,764, filed on Sep. 27, 2023.

(51) Int. Cl.
*F04D 29/26* (2006.01)

(52) U.S. Cl.
CPC ..... *F04D 29/26* (2013.01)

(58) Field of Classification Search
CPC . F04D 29/26; F04D 29/38; F16G 1/28; F16G 5/20
See application file for complete search history.

(56) References Cited

U.S. PATENT DOCUMENTS 2,906,097 A * 9/1959 Wacker ..... F01P 5/02 123/41.51
3,358,655 A * 12/1967 Camps ..... F01P 5/02 123/41.15
6,347,682 B1 * 2/2002 Buchner ..... B60L 50/20 180/220

FOREIGN PATENT DOCUMENTS

CN 219795598 U 10/2023
JP H09291821 A 11/1997
JP 2012082580 A * 4/2012 ..... F01P 11/10

OTHER PUBLICATIONS

English Machine Translation of JP 2012-82580 (Year: 2012).*
UK Intellectual Property Office, Search Report for related UK Application No. GB2316301.7, dated Feb. 15, 2024, 3 pages.

* cited by examiner

*Primary Examiner* — Aaron R Eastman
(74) *Attorney, Agent, or Firm* — RAY QUINNEY & NEBEKER; Daniel J. Bezdjian

(57) ABSTRACT

A fan assembly has a propeller with a plurality of fan blades and a fan power system including a driven sheave on a fan shaft connected to a drive sheave with a drive belt. The propeller is mounted within a fan shroud having an inner surface facing the propeller such that a tip clearance is formed between outer tips of the fan blades and the inner surface. The fan shroud has a belt pocket located on a circumferential path of the propeller, the belt pocket extending away from the inner surface and having a pocket floor that is offset from the inner surface and sized to allow the drive belt to fit between the outer tip of one of the plurality of fan blades and the pocket floor.

3 Claims, 4 Drawing Sheets

FAN CASING WITH DEFINED BELT POCKET

CROSS REFERENCE TO RELATED APPLICATION

This application claims the benefit of U.S. Provisional Application No. 63/585,764, filed Sep. 27, 2023, which is hereby incorporated by reference in its entirety.

BACKGROUND OF THE INVENTION

Field of Invention

This invention relates to fans in ventilation systems for animal buildings, and more particularly a fan assembly having a fan shroud with a belt pocket used to aid in the installation of a drive belt for the fan assembly.

Description of Related Art

Achieving optimal performance from animals raised in commercial animal house buildings (such as poultry or swine houses) depends in part on providing ventilation as correctly and efficiently as possible. Proper ventilation improves overall over air quality, air temperature, and energy usage. Improper ventilation levels can lead to incorrect moisture levels, unsuitable temperatures, poor air quality, animal mortality, and catastrophic fire situations endangering the animals and the employees at these facilities.

Ventilation fans are often used as part of the ventilation system for animal houses. The ventilation fans have a propeller with a number of fan blades driven by a power source that often uses a belt to drive the propeller. The fan usually has a fan shroud used to focus airflow around the propeller. To improve the performance of the ventilation fan, it is desirable that the clearance between the propeller tip and the inside diameter of shroud be small.

However, it is frequently necessary to change or install a new drive belt. Since drive belts on fans are a continuous loop, this may require that the new drive belt be passed between the fan shroud and the outer tip of one of the fan blades. Thus, the tip clearance needs to be sufficiently wide enough to allow the belt to be installed.

Accordingly, a need exists for a ventilation fan assembly that allows for changing of drive belts while minimizing tip clearance to provide optimal performance.

BRIEF SUMMARY

In one aspect, the invention is directed to a fan assembly having a propeller with a plurality of fan blades attached to a fan shaft. A fan power system including a driven sheave on the fan shaft is connected to a drive sheave with a drive belt, the drive sheave being driven by a motive force to thereby cause rotation of the propeller. The propeller is mounted within a fan shroud with the shroud having an inner surface facing the propeller such that a tip clearance is formed between outer tips of the fan blades and the inner surface of the fan shroud. The fan shroud has a belt pocket located on a circumferential path of the propeller, the belt pocket extending away from the inner surface and having a pocket floor that is offset from the inner surface and sized to allow the drive belt to fit between the outer tip of one of the plurality of fan blades and the pocket floor. The belt pocket allows for a section of the shroud to have enough clearance for installing the drive belt. A plug can be installed in the belt pocket to improve fan performance and prevent electrical and mechanical system efficiency losses and also to prevent untreated outside air ingression into the livestock space.

These and other features and advantages of this invention are described in, or are apparent from, the following detailed description of various exemplary embodiments of the systems and methods according to this invention.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
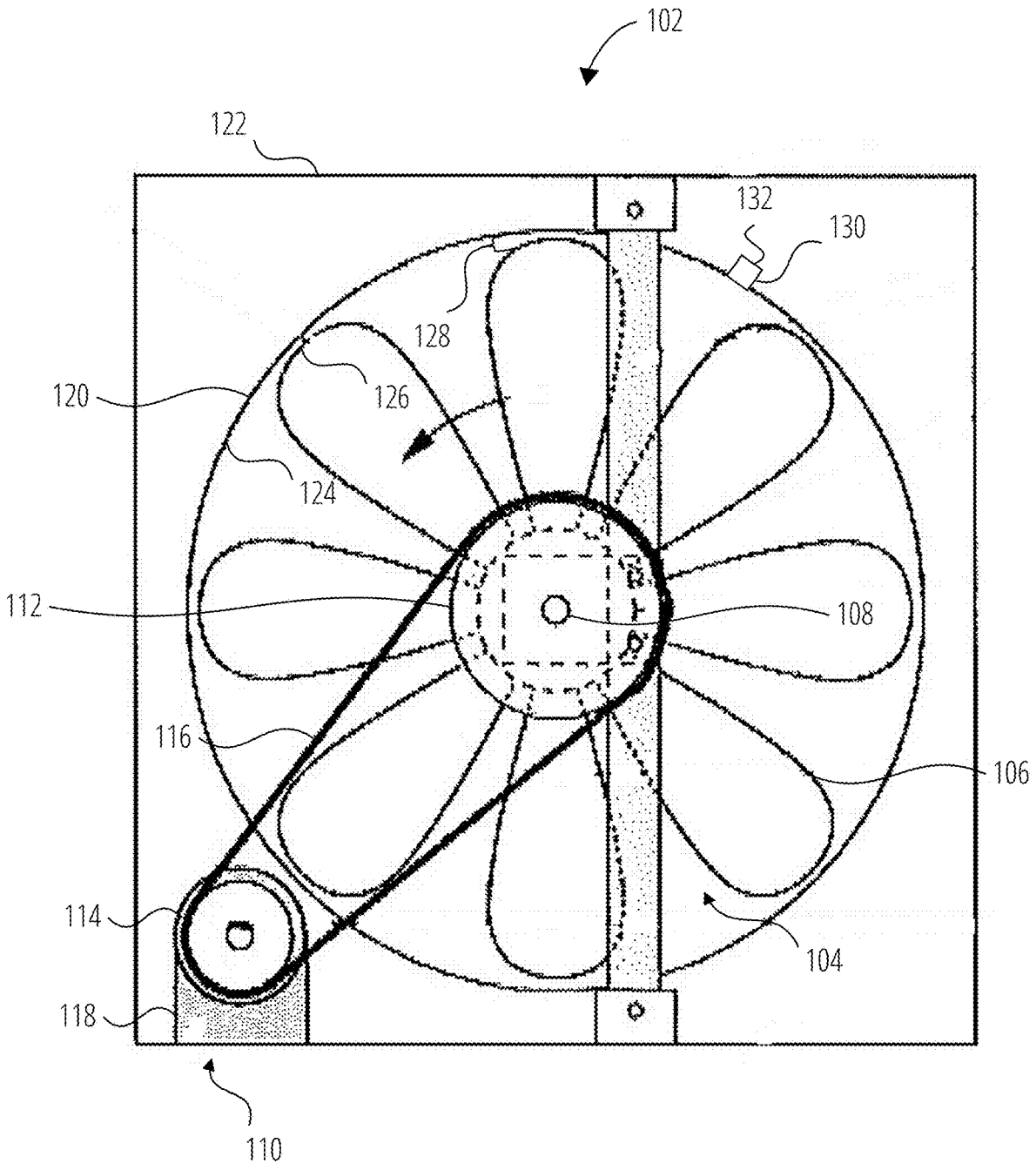
FIG. 1 illustrates a schematic view of a fan assembly.
Figure 2:
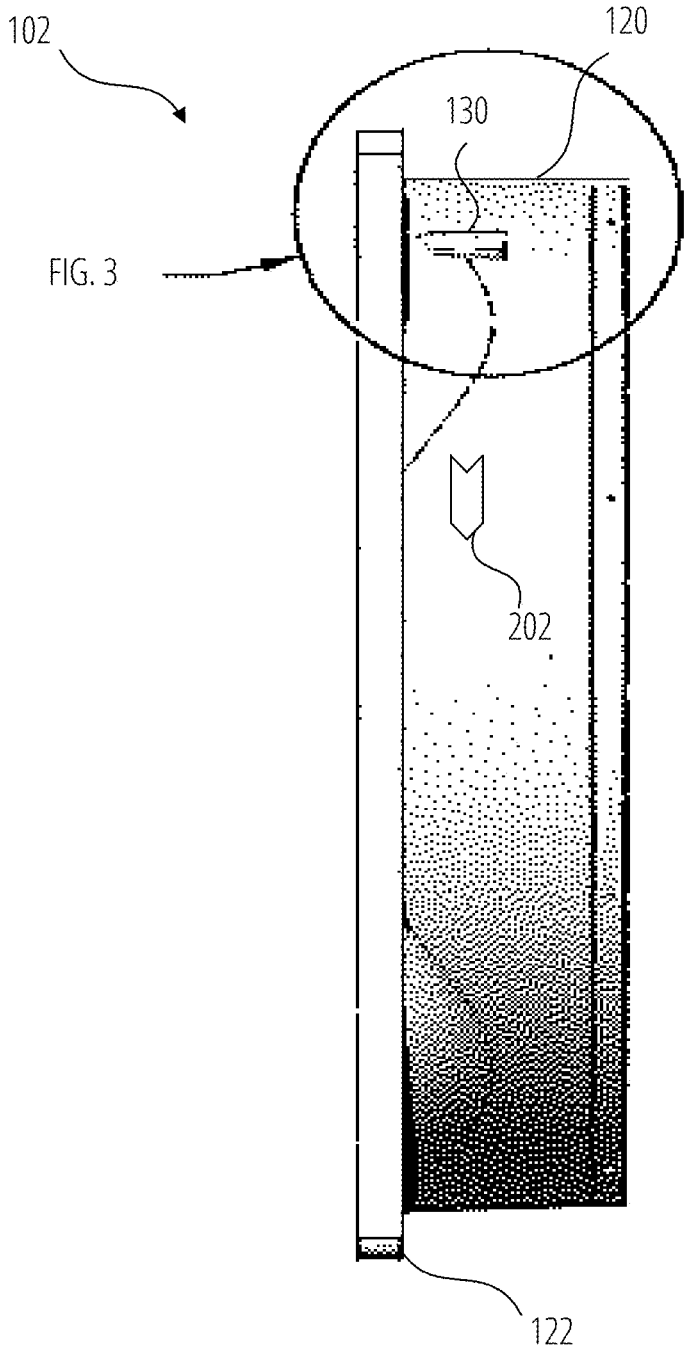
FIG. 2 illustrates a side view of the fan assembly of FIG. 1.
Figure 3:
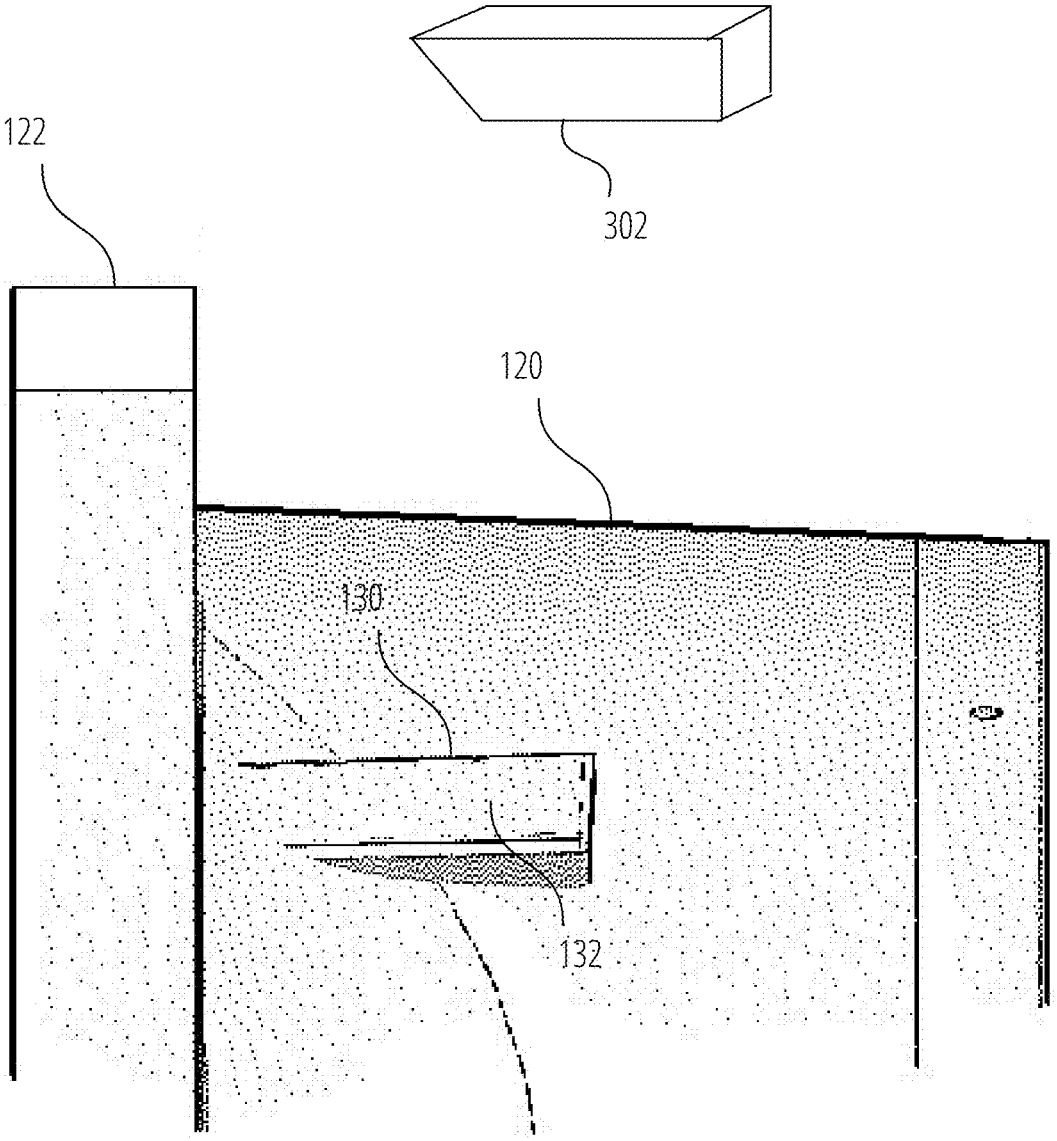
FIG. 3 illustrates an enlarged portion of the fan assembly 102 of FIG. 2.

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description. Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "left" or "right" are used as a matter of mere convenience and are determined by standing at the rear of the machine facing in its normal direction of travel. Furthermore, the various components shown or described herein for any specific application of this invention can be varied or altered as anticipated by this invention and the practice of a specific application of any element may already by widely known or used in the art by persons skilled in the art and each will likewise not therefore be discussed in significant detail.

As used herein, the singular forms following "a," "an," and "the" are intended to include the plural forms as well, unless the context clearly indicates otherwise. As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded. As used herein, the term "configured" refers to a size, shape, material composition, and arrangement of one or more of at least one structure and at least one apparatus facilitating operation of one or more of the structure and the apparatus in a predetermined way.

As used herein, any relational term, such as "first," "second," "top," "bottom," "upper," "lower," "above," "beneath," "side," etc., is used for clarity and convenience in understanding the disclosure and accompanying drawings, and does not connote or depend on any specific preference or order, except where the context clearly indicates otherwise.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.). As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

FIG. 1 illustrates a fan assembly 102 such as one installed in a portion of a sidewall of an animal house. The fan assembly 102 includes a propeller 104 having a number of fan blades 106 attached to a fan shaft 108. The fan assembly 102 also has a fan power system 110 including a driven sheave 112 on the fan shaft 108 connected to a drive sheave 114 with a belt 116. A motive force 118 which turns the drive sheave 114 thereby causes rotation of the propeller 104. The fan assembly 102 is mounted within a fan shroud 120 and fan housing 122 mounted in an opening in the sidewall of the animal house. The fan shroud 120 focuses airflow around the propeller 104 creating an airflow channel that pulls air through the housing 122 The motive force 118, propeller 104 and housing 122 of the fan assembly 102 may be of any suitable design known to one skilled in the art and need not be discussed further herein.

The fan shroud 120 has a smooth inner surface 124 facing the propeller 104. Outer tips 126 of the fan blades 106 come close to but do not contact the inner surface 124 of the fan shroud 120 such that there is a small tip clearance 128 around the circumference of the rotating propeller 104. To improve the performance of the fan assembly 102, it is desirable that the tip clearance 128 be as small as practicable. However, it is occasionally necessary to change the drive belt 116 requiring the new drive belt 116 be passed through the tip clearance 128 between the inner surface 124 of the fan shroud 120 and the outer tip 126 of one of the fan blades 106.

Figure 4:
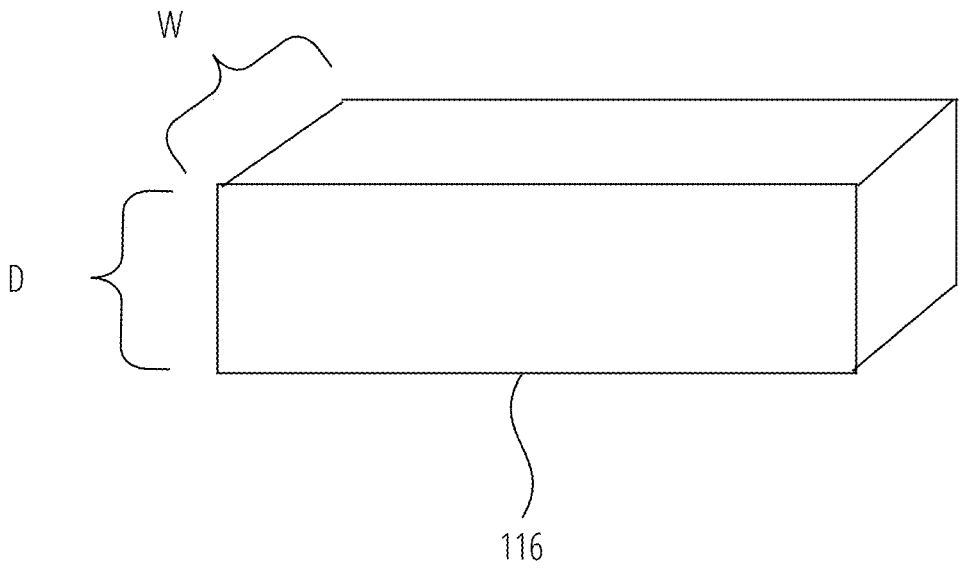
FIG. 4 illustrates a portion of a drive belt for the fan assembly of FIG. 1.

According to the invention, the fan shroud 120 is positioned relative to the propeller 104 such that the drive belt does not fit through the tip clearance 128 because the drive belt 116 has width and depth dimensions W and D (FIG. 4) that are each greater than the tip clearance 128. The fan shroud 116 has a belt pocket 130 formed therein located on a circumferential path 202 of the propeller 104. The belt pocket 130 extends away from the inner surface 124 of the fan shroud 120 and has a pocket floor 132 that is offset from the inner surface 124. The pocket floor 132 is positioned such that the belt pocket 130 is wide and deep enough to allow the dimensions W and D of drive belt 116 of the fan power system 110 to fit between the outer tip 126 of the fan blade 106 and the pocket floor 132 of the belt pocket 130 when the belt 116 is being changed. In one embodiment, the belt pocket 130 is filled by a plug 302 when not being used to install a belt 116. Having the belt pocket 130 allows the fan assembly 102 to have a minimal tip clearance 128 between the remainder of the inner surface 124 of the fan shroud 120 and the outer tips 126 of the propeller circumference which leads to better performance of the fan assembly 102.

In one embodiment, the belt pocket 130 is filled by a plug 302 when not being used to install a belt 116. The plug 302 is installed in the belt pocket to improve fan performance and prevent electrical and mechanical system efficiency losses and also to prevent untreated outside air ingression into the livestock space. The plug 302 may be made using any known construction method or material. Having the belt pocket 130 allows the fan assembly 102 to have a minimal tip clearance 128 between the remainder of the inner surface 124 of the fan shroud 120 and the outer tips 126 of the propeller circumference which leads to better performance of the fan assembly 102.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings.

What is claimed is:

1. A fan assembly having a propeller with a plurality of fan blades attached to a fan shaft and a fan power system including a driven sheave on the fan shaft connected to a drive sheave with a drive belt, the drive sheave being driven by a motive force to thereby cause rotation of the propeller wherein the propeller is mounted within a fan shroud having an inner surface facing the propeller such that a tip clearance is formed between outer tips of the fan blades and the inner surface of the fan shroud, wherein the fan shroud has a belt pocket formed therein located on a circumferential path of the propeller, the belt pocket extending away from the inner surface and having a pocket floor that is offset from the inner surface and sized to allow the drive belt to fit between the outer tip of one of the plurality of fan blades and the pocket floor.

2. The fan assembly of claim 1, wherein the belt has width and depth dimensions greater than the tip clearance such that the drive belt does not fit through the tip clearance.

3. The fan assembly of claim 1, further comprising a plug that fills the belt pocket when the belt pocket is not being used to install a belt.

* * * * *